US011820121B2

(12) United States Patent
Street et al.

(10) Patent No.: US 11,820,121 B2
(45) Date of Patent: Nov. 21, 2023

(54) HEAT IMAGE FORMING DEVICE AND METHOD

(71) Applicant: Palo Alto Research Center Incorporated, Palo Alto, CA (US)

(72) Inventors: Robert A. Street, Palo Alto, CA (US); Jengping Lu, Fremont, CA (US)

(73) Assignee: Xerox Corporation, Norwalk, CT (US)

( * ) Notice: Subject to any disclaimer, the term of this patent is extended or adjusted under 35 U.S.C. 154(b) by 284 days.

(21) Appl. No.: 17/462,043

(22) Filed: Aug. 31, 2021

(65) Prior Publication Data

US 2022/0227142 A1 Jul. 21, 2022

Related U.S. Application Data

(60) Provisional application No. 63/139,181, filed on Jan. 19, 2021.

(51) Int. Cl.

| | |
|---|---|
| ***B41F 13/08*** | (2006.01) |
| ***B41J 2/34*** | (2006.01) |
| ***B41J 2/335*** | (2006.01) |
| ***B41C 1/10*** | (2006.01) |
| ***B41F 7/08*** | (2006.01) |
| ***B41F 7/26*** | (2006.01) |

(Continued)

(52) U.S. Cl.

CPC ..... *B41F 13/08* (2013.01); *B41C 1/1041* (2013.01); *B41F 7/02* (2013.01); *B41F 7/08* (2013.01); *B41F 7/26* (2013.01); *B41F 31/002* (2013.01); *B41F 31/08* (2013.01); *B41F 31/13* (2013.01); *B41J 2/33535* (2013.01); *B41J 2/34* (2013.01); *B41M 1/06* (2013.01); *B41N 3/03* (2013.01); *B41C 1/1033* (2013.01); *B41P 2227/70* (2013.01)

(58) Field of Classification Search

CPC .... B41F 13/08; B41F 7/02; B41F 7/08; B41F 7/26; B41F 31/002; B41F 31/08; B41F 31/13; B41F 7/265; B41F 7/30; B41F 23/0409; B41F 31/06; B41F 31/20; B41F 31/28; B41F 33/0054; B41F 7/00; B41C 1/1041; B41C 1/1033; B41J 2/33535; B41J 2/34; B41M 1/06; B41M 5/0256; B41N 3/03; B41P 2227/70

See application file for complete search history.

(56) References Cited

U.S. PATENT DOCUMENTS 5,109,240 A * 4/1992 Engl ..... B41C 1/1058 347/111

* cited by examiner

*Primary Examiner* — Lisa Solomon

(74) *Attorney, Agent, or Firm* — Caesar Rivise, PC

(57) ABSTRACT

A heating circuit having an array of switching heating elements (e.g., field effect transistors, thin film transistors) provides a transient heat pattern over a surface (e.g., substrate, imaging member surface, transfer roll surface) moving relative to the heating circuit, to produce a pixelated heat image and heat a target pattern on the surface. Heat is generated by current flow in the heating elements, and the power developed by the heating circuit is the product of source-drain voltage and current in the channel. Digital addressing may accomplished by matrix addressing the array. Current may be supplied along data address lines by an external voltage controlled by digital electronics understood by a skilled artisan to provide the desired heat at a respective heating element pixels addressed by a specific gate line. The circuit may include a current return line that may be low resistance, for example, by using a 2-dimensional mesh.

20 Claims, 4 Drawing Sheets

(51) Int. Cl.

| | |
|---|---|
| ***B41M 1/06*** | (2006.01) |
| ***B41F 7/02*** | (2006.01) |
| ***B41F 31/00*** | (2006.01) |
| ***B41F 31/13*** | (2006.01) |
| ***B41F 31/08*** | (2006.01) |
| ***B41N 3/03*** | (2006.01) |

HEAT IMAGE FORMING DEVICE AND METHOD

CROSS-REFERENCE TO RELATED APPLICATIONS

This application claims the benefit under 35 U.S.C. § 119(e) of Application Ser. No. 63/139,181 filed on filed on Jan. 19, 2021 entitled NEXT GENERATION FOUNTAIN SOLUTION IMAGE FORMATION AND TRANSFER and whose entire disclosure is incorporated by reference herein.

FIELD OF DISCLOSURE

This invention relates generally to digital printing systems, and more particularly, to heat image forming systems and methods for selective thermal transfer useable in lithographic offset printing systems.

BACKGROUND

The application of heat is used in many technological situations, including image forming operations. Conventional digital imaging systems receive electronic image(s), which are passed to an image-processing unit. The image-processing unit may be a combination of software and hardware elements that accepts the electronic images from different sources and performs operations needed to convert the images to the format compatible with the output path of the digital reprographic system.

Conventional digital imaging systems may create images or printings using various types of image forming operations, including direct imaging processes such as elecrophotography, xerography, iconography, magnetography, ink jet technology, and thermal technology. In an exemplary digital imaging system, an aptly programmed hardware element, generally known as a raster image processor, converts the image in a page description language (PDL) or vector graphics format (VGF) to a bit mapped image indicating a value to print at each pixel of the image. Each bit representing a pixel that is "on" is converted to an electromagnetic pulse. The electromagnetic pulses generated from the raster pel data at which to deposit toner turns the laser beam on to positively charge the surface of a rotating drum that has a coating capable of holding an electrostatic charge. The laser beam turns on and off to beam charges at pixel areas on a scan line across the drum that will ultimately represent the output image. After the laser beam charges all pels on the scan line indicated in the raster data, the drum rotates so the laser beam can place charges on the next scan line. The drum with the electrostatic positive charges then passes over negatively charged toner. The negatively charged toner is then attracted to the positive charged areas of the drum that form the image. The print media, which is negatively charged, passes over the roller drum and attracts the toner as the areas of the roller drum with the toner are positively charged to transfer the toner forming the image from the roller drum to the print media.

Conventional digital imaging systems also include digital lithography imaging of variable image data for producing images on a substrate that are changeable with each subsequent rendering of an image on the substrate in an image forming process. For example, a digital offset printing process may include transferring ink onto a portion of an imaging member (e.g., fluorosilicone-containing imaging member, printing plate) having a surface or imaging blanket that has been selectively coated with a fountain solution (e.g., dampening fluid) layer according to variable image data. The fountain solution forms a film on the silicone plate that is on the order of about one (1) micron thick. The drum rotates to an 'exposure' station where a high power laser imager is used to remove the fountain solution at the locations where the image pixels are to be formed. This forms a fountain solution based 'latent image'. The drum then further rotates to a 'development' station where lithographic-like ink is brought into contact with the fountain solution based 'latent image' and ink 'develops' onto the places where the laser has removed the fountain solution. The ink is usually hydrophobic for better adhesion on the plate and substrate. An ultra violet (UV) light may be applied so that photo-initiators in the ink may partially cure the ink to prepare it for high efficiency transfer to a print media such as paper. The drum then rotates to a transfer station where the ink is transferred to a printing medium such as paper. The silicone plate is compliant, so an offset blanket is not used to aid transfer. UV light may be applied to the paper with ink to fully cure the ink on the paper.

In some instances, the ability to form a transient heat pattern over a surface is useful to these imaging approaches. It would be beneficial to provide such transient heat patterns accurately and efficiently using reduced power consumption than conventional heaters and light sources.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a heat image forming device for selectively heating an adjacent surface. The heat image forming device may include an array of switching heating elements and a plurality of conductive lines. Each switching heating element may include a field effect transistor, with the transistors each having a semiconductor layer, a gate electrode, a source electrode, a drain electrode and a dielectric layer deposited as thin-films onto a substrate, the gate electrode separated from the drain electrode and source electrode by the dielectric layer. The semiconductor layer has a current channel defined by a spatial gap between the source electrode and gate electrode, and an overlapping distance of the drain and source electrodes in the semiconductor layer. The plurality of conductive lines includes gate address lines, current supply data lines, and current return lines, with each one of the gate electrodes electronically coupled to one of the gate lines, each one of the source electrodes electronically coupled to one of the data lines, and each one of the drain electrodes electronically coupled to one of the current return lines. Each heating circuit has a current supplied via a connecting current supply data line in the current channel that is controlled by a voltage applied to the gate electrode via a connecting gate address line. In examples, the current channel is closer to the surface being heated than the current return lines.

According to aspects illustrated herein, an exemplary method for selectively heating an adjacent surface with a heat image forming device is discussed, wherein the adjacent surface includes a plurality of regions, with some of the regions including a patterned image on the surface or areas of the surface where the patterned image will be rendered. The method includes moving the patterned image of the adjacent surface and the array of switching heating elements relative to each other, selectively switching the heating elements proximal to the moving patterned image to a first state based on the patterned image, and heating the regions including the patterned image or areas of the surface where the patterned image will be rendered.

According to aspects described herein, a system for selectively heating an adjacent surface with the heat image forming device is discussed, wherein the adjacent surface includes a plurality of regions, with some of the regions including a patterned image on the surface or areas of the surface where the patterned image will be rendered. The system includes a processor and a memory, the memory storing instructions to cause the processor to perform moving the patterned image of the adjacent surface and the array of switching heating elements relative to each other, selectively switching the heating elements proximal to the moving patterned image to a first state based on the patterned image, and heating the regions including the patterned image or areas of the surface where the patterned image will be rendered.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION

Figure 1:
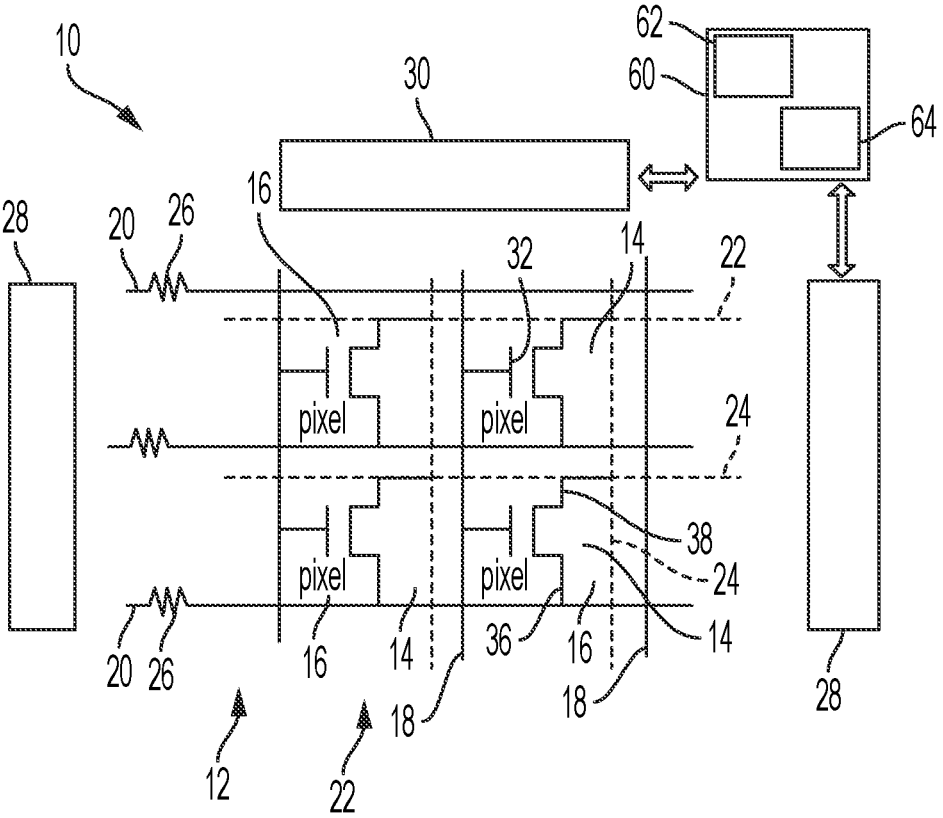
FIG. 1 is a diagram illustrating a heat image forming device in accordance with examples of embodiments.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface of a digital imaging member.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" or "control system" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "image forming device", "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

The term "fountain solution" or "dampening fluid" refers to dampening fluid that may coat or cover a surface of a structure (e.g., imaging member, transfer roll) of an image forming device to affect connection of a marking material (e.g., ink, pigmented toner, pigmented or dyed particles or fluid) to the surface. The fountain solution may include water optionally with small amounts of additives (e.g., isopropyl alcohol, ethanol) added to reduce surface tension as well as to lower evaporation energy necessary to support subsequent laser patterning. Low surface energy solvents, for example volatile silicone oils, can also serve as fountain solutions. The fountain solution may be non-aqueous including, for example, silicone fluids (such as D3, D4, D5, OS10, OS20, OS30 and the like), Isopar fluids, and polyfluorinated ether or fluorinated silicone fluid.

In examples, an approach for providing a transient heat pattern over a surface (e.g., substrate, imaging member surface, transfer roll surface) where in operation a pixelated heat image is produced by heating circuits. In aspects of the approach, a heating circuit having an array of switching heating elements (e.g., field effect transistors (FETs), thin film transistors (TFTs) is discussed. Heat is generated by current flow in the heating circuit, and the power developed by the heating circuit is the product of the source-drain voltage and the current in the channel, which is proportional to the effective carrier mobility. Digital addressing may be accomplished by matrix addressing the array, for example, with orthogonal gate and data address lines. Current may be supplied along the data lines by an external voltage controlled by known digital electronics to provide the desired heat at a respective pixel addressed by a specific gate line. The circuit may include a current return line that can be made low resistance, for example, by using a 2-dimensional mesh.

Benefits include the ability to heat at pixel-sized areas in an addressable fashion so that circuit heating might be used at least in the architecture discussed herein. The design of the heating elements and addressing circuitry may be used in different applications including over an inking blanket. Examples include curing a material in a pattern, localized phase change of a material, image-wise evaporation of a liquid material, patterned chemical reactivity, and a spatially moving heat scan pattern. Exemplary designs are described in which the array is close to the object being heated. Such a heat image forming device may include an array of heating elements that are switchable, digitally addressable, close to the surface, with high area coverage of the heating elements, and scalable in pixel size and array size. The heating elements may each have a separate small transistor, meaning the amount of charge needed to control it is also small. This allows for very fast re-drawing of the switchable heating elements to match an adjacent pattern to be heated, even when the heating elements and adjacent pattern move relative to each other.

FIG. 1 depicts an exemplary heat image forming device 10 having a circuit arranged as an array 12 of heating elements 14 that are switchable between an "on" heating state and an "off" heating or non-heating state. Each heating element 14 includes a switch-device, which actively maintains the heating state while other heating elements of the array 12 are being addressed, also preventing crosstalk from inadvertently changing the state of an unaddressed heating element. In examples, each heating element 14 may be pixel sized and correspond with a respective pixel of an adjacent surface object 46 (FIG. 2) to be heated. While not being limited to a particular theory, the heating elements 14 may include transistors, such as field effect transistors (FETs) and are shown in the figures by example as thin film transistors (TFTs) 16 (e.g., FETs that may be based on non-crystalline thin-film silicon (a-Si), polycrystalline silicon (poly-Si), or CdSe semiconductor material). In examples the TFTs may be both the heating element 14 switch-devices and the heater for the heating element 14 via current flow in the TFT channel, as will be described in greater detail below.

Heat may be generated by current flow in the TFT 16 and the power developed by the TFT is understood as the product of the source-drain voltage and the current in the channel, which is proportional to the effective carrier mobility. Digital addressing may be accomplished by matrix addressing (e.g., active, passive) the array 12 with orthogonal gate address lines 18 electronically coupled to gate electrodes and with current supply data lines 20 electronically coupled to source electrodes, for example, as shown in FIG. 1. Current may be supplied along the data lines 20 by an external voltage controlled by known digital electronics as understood by a skilled artisan to provide desired heat at the heating element 14 addressed by a specific gate line. This desired heat then heats the corresponding respective pixel of the adjacent surface, which may have a material thereon heated by heat transfer from the heating element 14. The corresponding respective pixel refers to a region of the surface or material (e.g., surface object 46 (FIG. 2)) that is heated by a heating element at the moment the heating element and corresponding respective pixel are proximal (e.g., next to, closest, adjacent) to each other. As the array 12 of heating elements 14 and the surface move relative to each other, the corresponding respective pixel or surface object for each heating element changes based on the movement.

The circuit may require current return lines 22 shown in FIG. 1 as dashed lines electronically coupled to drain electrodes. The current return lines 22 may be low resistance, for example less than 100 ohms as a 2-dimensional mesh 24. While not being limited to a particular theory, the data lines 20 may have a significant total line resistance 26 which may be taken into account via the current return lines 22. For example, the data line resistance within a pixel may be in the range 1 to 10 ohms so that if the data line extends over 1000 pixels the total data line resistance may be 1 to 10 kohm.

The heat image forming device 10 may also include data line drivers 28 and gate line drivers 30. The gate line drivers 30 (e.g., power amplifier) may accept a low-power input from a power source and produce a high-current drive input for the gate address lines 18. The data line drivers 28 provide timing signals to switch the heating elements 14 as desired by matrix addressing to provide a transient pixelated heat pattern over a surface as well understood by a skilled artisan. The transient pixelated heat pattern may match a pattern (e.g., patterned image, digitally patterned image, predetermined pattern) of material on the adjacent surface to be heated, and may change as the adjacent surface moves to continually match the pattern of material. Data line drivers 28 may be coupled to the current supply data lines 20 on one or both ends of the array.

While not being limited by a particular theory, different FET technologies may be used depending on temperature and power requirements of the heating elements 14. Temperature limits for heating may be set in accordance with materials used to fabricate the TFTs 16 and power may be set or adjusted due in part by the TFT mobility, since high mobility corresponds to high current and therefore high power. The maximum source-drain and gate voltages also limit the power that can be developed and depend on the specific TFT, as well understood by a skilled artisan. Examples of TFT materials include polysilicon (e.g., LTPS), oxide semiconductors (e.g., InGaZnO (IGZO)), and amorphous silicon. LTPS polysilicon may be fabricated by laser recrystallization of a deposited silicon film. LTPS has a typical electron mobility of about 150-200 $cm^2/Vs$ and hole mobility of about 50-100 $cm^2/Vs$. LTPS has a temperature limit of about 350° C. and can be fabricated on glass, quartz or polyimide. Oxide semiconductors have a general mobility of about 40-50 $cm^2/Vs$ and maximum temperature of about 300-400° C. These materials are typically sputtered but may also be deposited from solution and annealed. Amorphous silicon has a general mobility of about 0.5 $cm^2/Vs$ and maximum temperature of about 250° C. A-Si is typically deposited by plasma enhanced chemical vapor deposition.

The above materials may be produced on rigid or flexible substrates and capable of large area arrays. Matrix addressing is a known technique and the driver electronics are known as well understood by a skilled artisan. These arrays 12 are capable of pixel size down to about 50 μm and are fabricated in large areas up to about 3×3 m. Other TFT materials that are demonstrated but not in volume manufacturing include carbon nanotubes and organic semiconductors. Carbon nanotubes have a general mobility of about 50-80 $cm^2/Vs$ and a temperature limit of over 500° C. Organic semiconductors have a general mobility of about 1-5 $cm^2/Vs$ and a temperature limit of about 200° C.

The process carried out by the heat image forming device 10 to provide a transient pixelated heat pattern over a surface in an addressable fashion may be sequenced and controlled using one or more controllers 60. The controller 60 may read and execute heat instructions generated by an outboard computer (not depicted) based on a pattern of a material or object that is to be heated. For example, the array 12 of heating elements 14 may be selectively operated by matrix addressing as discussed herein based on input from the controllers. While the controller 60 is shown in communication with the heat image forming device 10, it is understood that the controller may be in communication with any component of a system or device associated with the heat image forming device, including the surface to be heated.

Thus operation and control of the heat image forming device 10 and adjacent surface to be heated may be performed with the aid of the controller 60, which is implemented with general or specialized programmable processors 62 that execute programmed instructions. The controller is operatively connected to memory 64 that stores instruction code containing instructions required to perform the programmed functions. The controller 60 executes program instructions stored in the memory 64 to form heated patterns on the surface to be heated (e.g., surface object 46 (FIG. 2)) with reference to image data that correspond to a pattern of material or surface area on the surface. The controller 60 operates the array 12 of heating elements 14 and the surface to be heated to form the heated patterns. The memory 64 may include volatile data storage devices such as random access memory (RAM) and non-volatile data storage devices including magnetic and optical disks or solid state storage devices. The processors, their memories, and interface circuitry configure the controllers and/or heating elements 16 to perform the functions described herein. These components may be provided on a printed circuit card or provided as a circuit in an application specific integrated circuit (ASIC). In one embodiment, each of the circuits is implemented with a separate processor device. Alternatively, the circuits can be implemented with discrete components or circuits provided in VLSI circuits. Also, the circuits described herein can be implemented with a combination of processors, ASICs, discrete components, or VLSI circuits.

Figure 2:
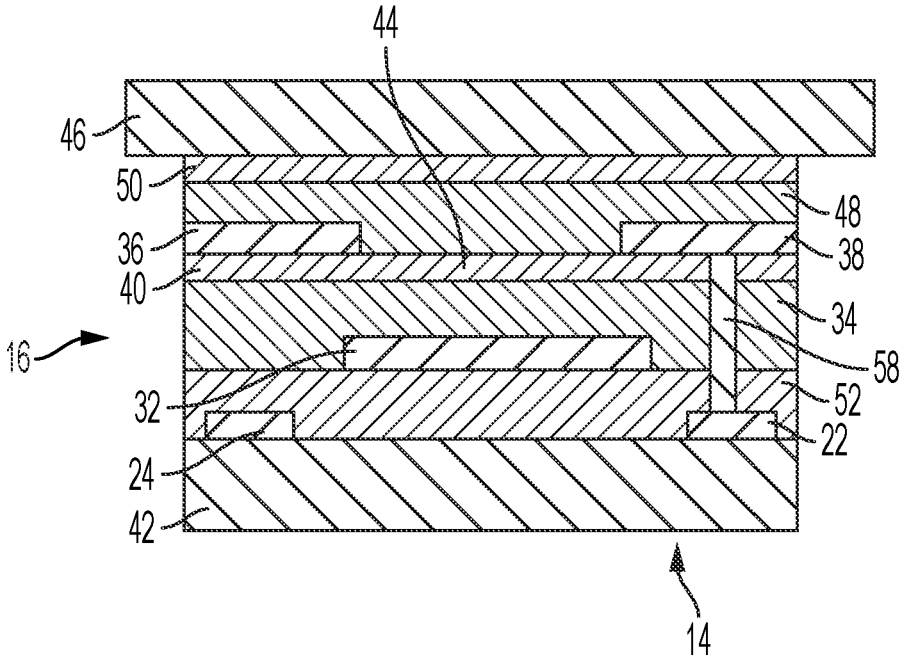
FIG. 2 is a side schematic view partially in cross of a bottom gate heating element in accordance with examples.

FIG. 2 depicts an exemplary schematic illustration of a bottom gate heating element 14 in an order of deposition. The heating element 14 includes a bottom gate TFT 16 with (in general order of deposition) a gate electrode 32, gate dielectric 34, source and drain metal contacts or electrodes 36, 38 (for current supply and return) and semiconductor layer 40, which may be deposited as thin-films onto a substrate 42. The substrate 42 provides mechanical support to the heating element 14 and it does not interfere with the electrical characteristics of the heating element. The gate electrode 32 is conductive (e.g., metal, chromium, aluminum, silver, gold) and provides signals to the semiconductor 40 which activates the contact between the source and drain electrodes 36, 38. The semiconductor 40 has a current channel 44 defined by a gap between the source electrode 36 and gate electrode 32, and an overlapping distance of the drain and source electrodes in the semiconductor layer. The source and drain electrodes 36, 38 may be formed by two long parallel conductive stripes deposited adjacent the semiconductor 40 and separated by the gap. The electrodes may have a conductive coating, for example, indium tin oxide. The array 12 may be encapsulated in a polymer or ceramic material.

The heating element 14 shown in the figures is an electronic switch heater, having the current between source electrode 36 and drain electrode 38 controlled (or modulated) by the voltage applied to the gate electrode 32, which is separated from the drain and source electrodes by the highly insulating gate dielectric layer 34. The current flows in the plane of the semiconductor 40, perpendicularly to the applied gate voltage. Bottom gate heating elements 14 are not limited to this configuration, as for example, the source-drain electrodes 36, 38 may be underneath the semiconductor 40 rather than on top.

Heat may be developed in the current channel 44, which is near the top surface of the heating element 14 and adjacent a surface object 46 to be heated. In fact, in specific examples the current channel 44 may be closer to the surface object 46 than the current return lines 22, the data lines 20 and the gate lines 18. A passivation layer 48 may be deposited above the semiconductor layer 40 and on top of the current channel 44 to protect the source-drain contacts and the current channel. The passivation layer 48 may be an insulator such as silicon oxide. The current channel 44 may be less than about 200 nm or only about 10-100 nm thick. A surface layer 50 may be added and provide a specific contact material to the object 46 being heated. In examples, the surface layer 50 may be a patterned pad made of a high thermal conductivity material (e.g., a metal) to ensure a uniform temperature across the heating element 14 pixel. The passivation layer 48 and the surface layer 50 may be very thin (e.g., less than 250 nm, less than 150 nm, about 15-150 nm thick) so that the current channel heat source is very close to the object 46 being heated.

Still referring to FIG. 2, the heating element 14 includes current return mesh metal 24 conductively coupled to the drain contact 38 via metalized vias 58 therebetween, and separated from the gate electrode 32 by a dielectric layer 52. The dielectric 34, 52 prevent electrical shorting between the semiconductor 40, gate electrode 32 and mesh metal 24. The current return lines 22 of metal mesh 24 are not part of a typical TFT design since it is not needed or considered for other TFT arrays (e.g. liquid crystal display). The current return mesh 24 may be a separate layer positioned underneath the gate electrode 32, rather than on top of the current channel 44 so that the current channel is as close as reasonable to the surface 50 to provide a most effective and efficient heater array 12.

The example depicted in FIG. 2 may be used with an oxide semiconductor or amorphous silicon, both of which are typically made as bottom gate TFTs. Other semiconductor materials are feasible as understood by a skilled artisan. The TFT structure may be conventionally made by photolithographic patterning but could also be made by other approaches, such as by direct additive printing techniques, provided the pixel size is consistent with the printing technology.

Polysilicon may be used in a heater array because of its high mobility and hence high heating power. However, the LTPS array is fabricated as a top gate TFT largely because the process starts with the laser crystallization of a thin silicon film on a substrate to form the channel. In the top gate geometry, the heat source which is the TFT channel is necessarily separated from the top surface by a significant thickness of material because of the presence of the gate dielectric, the source-drain contacts and the mesh metal return. This combination of layers might be 2 or more microns thick. The thickness might be suitable for some applications but a thinner separation between the TFT channel heater element and the surface is desirable for applications requiring faster or more efficient heating.

Figure 3:
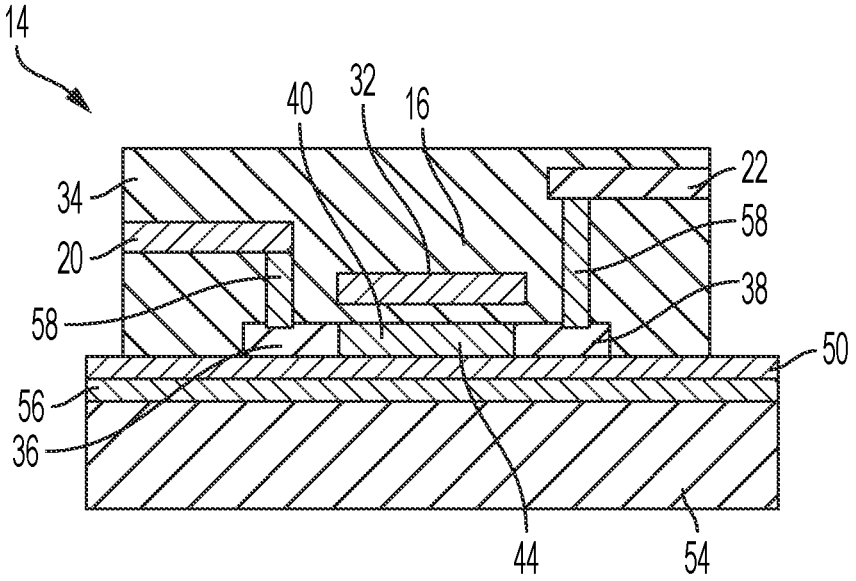
FIG. 3 is a side schematic view partially in cross of a top gate heating element in accordance with examples.
Figure 4:
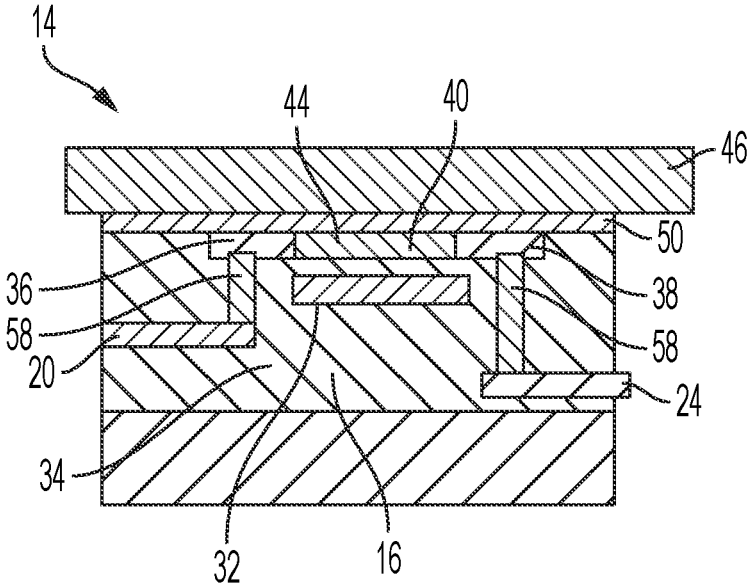
FIG. 4 is a side schematic view partially in cross of an inverted top gate heating element in accordance with examples.

FIG. 3 depicts an exemplary schematic illustration of a top gate heating element 14 in an order of fabrication. The heating element 14 includes a top gate TFT 16 with a thin surface layer 50 mounted on a carrier substrate 54. The carrier substrate 54 is a base on which the electronic heating elements are fabricated, and may be a flexible substrate made, for example, out of glass a few micron thick, metals and/or polymers such as polyethyleneteraphalate. The TFT 16 is shown in top gate configuration on the surface layer 50 with the semiconductor layer 40, source and drain electrodes 36, 38, gate dielectric 34, and gate electrode 32, with the gate dielectric surrounding the gate electrode and separating the gate electrode from the current return mesh 24. FIG. 4 depicts an exemplary schematic of the same top gate TFT 16 released from the carrier substrate 54 and inverted onto a support substrate 42 to form the heating element 14. According to examples, the heat source current channel 44 may be designed closer to the surface 50 to be heated by depositing the TFT 16 on the carrier 54 for the fabrication of the top gate heating element 14 and then removing the TFT from the carrier.

As can be seen in FIG. 3, between the carrier substrate 54 and the current channel 44 may be one or more layers 56 to affect release. The release layer(s) 56 may include a deposited insulator, spin on material, or combinations of the two on the carrier substrate. In examples, the release layer 56 may be polyimide and the surface layer 50 may be a deposited silicon oxide. The release layer 56 may be delaminated from the carrier substrate 54 by a known process such as laser lift off. If necessary the release layer 56 may be removed, for example by etching, leaving only a thin oxide on top of the semiconductor current channel 44.

As noted above regarding the structure of the exemplary inverted top heating element 14 depicted in FIG. 4, the TFT 16 includes doped source and drain contacts 36, 38 and gate electrode 32. The source electrode 36 may be coupled to the data line 20 by metalized vias 58. Similarly the drain electrode 38 may be coupled to the current return mesh 24 by metalized vias 58, and the gate electrode 32 is coupled to a gate line 18 (FIG. 1). The metal current return mesh 24 may be a separate metal layer. The support substrate 42 may be laminated onto the TFT before or after the delamination to give robustness after release from the carrier substrate 54. The support substrate 42 may be flexible or rigid depending on the example, as understood by a skilled artisan. As in the example depicted in FIG. 2, a surface layer 50 may be added between the TFT 16 and the object 46 to be heated to provide uniform heating.

The heater current is transmitted along the data lines 20 to respective heater elements 14. For a large heater array 12 with many field effect transistor pixels, the data lines 20 may be long and narrow (e.g., less than a third the pixel width by over 1000 pixels long, about 2-10 μm and extending over 1000 pixels). Thin film array fabrication may limit the metal thickness of the data lines 20 such that the smallest line resistance may be about 0.1 ohm/sq. An effect of these conditions may be to introduce a significant voltage drop (e.g., about 25%, more than about 20%) along the data line so that heater elements 14 distal the voltage source will pass a lower current than heater elements proximal to the voltage source, such that heating may be non-uniform across the length of the array 12. To prevent significant non-uniform heating, the voltage drop along the data line should be minimal, for example, less than about 5% or no more than about 1V out of an applied 20V supply. There are various ways that can be used individually or in combination to solve this problem of excessive voltage drop. For example, connecting data line drivers 28 to opposite ends of the data lines 20 reduces voltage drop. In addition, a large voltage drop (e.g., about 5V out of a 20V supply) may be compensated by the controller 60 controlling the data drivers 28 to increase the applied voltage at the locations where voltage drop is larger. Another exemplary approach is to vary the heating element 14 or TFT 16 design, for example the width-to-length ratio W/L, across the array 12 so that a lower voltage in the center of the array produces the same power and heat from center heating elements as edge heating elements receiving a higher voltage at the edge of the array.

The current return lines 22 also have a resistive voltage drop. However, the current return mesh 24 minimizes resistance when formed as a 2-dimensional metal grid as shown by example in FIG. 1. The mesh 24 resistance is negligible (e.g., less than 5% of the data line resistance) compared to the data line 20 resistance, as understood by a skilled artisan.

It is understood that the heating element TFTs 16 can be constructed in diverse ways, with a difference among these structures being the position of the electrodes 32, 36, 38 relative to the active semiconductor 40. For example, the top gate TFT depicted in FIGS. 3 and 4 has the semiconductor 40 coplanar with the source and drain electrodes. In a top gate, bottom-contact configuration the gate electrode 32 is on top of the gate dielectric layer 34, and the source and drain electrodes 36, 38 are lower layers underneath the semiconductor 40 and just above the surface layer 50. In this structure, the source and drain electrodes 36, 38 can also be deposited by lift-off photolithography or shadow mask thermal evaporation directly onto the surface layer 50. Top gate, top-contact TFT 16 configuration is similar to TGBC configuration with a difference that the source and drain electrodes 36, 38 are deposited onto the semiconductor 40. Bottom gate configurations, such as depicted in FIG. 2, have three common stages (support substrate 42, gate electrode 32 and gate dielectric 34) with additional stages above the substrate and below the gate electrode for the dielectric layer 52 and the current return line 22 or mesh 24 deposition. Of course in the bottom gate configurations, the semiconductor 40 may be coplanar and/or either above or below the source and drain electrodes 36, 38.

Figure 5:
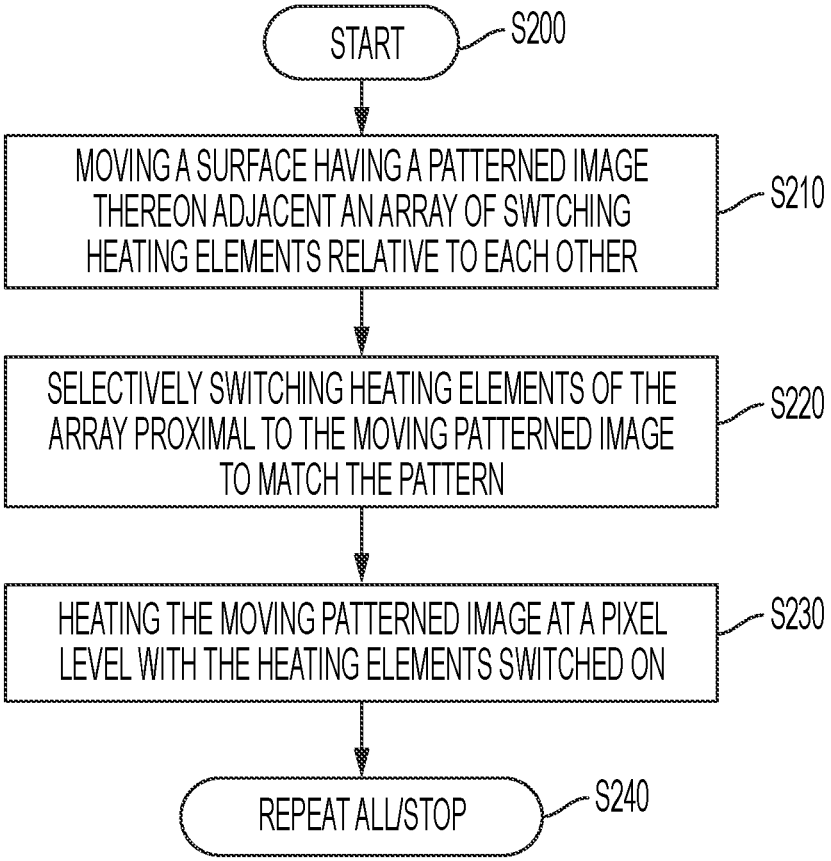
FIG. 5 is a flowchart depicting the operation of a heat image forming device in accordance with examples.

The disclosed embodiments may include an exemplary method for selectively heating an adjacent surface with the heat image forming device 10. FIG. 5 illustrates a flowchart of such an exemplary method. As shown in FIG. 5, operation of the method commences at Step S200 and proceeds to Step S210.

At Step S210, a surface of a conventional digital imaging system adjacent an array of switching heating elements move respective to each other across the array. In other words, the surface may move and/or the array may move such that the surface and array move relative to each other. The surface may have a patterned image on the surface or regions thereon where a patterned image will be rendered. The patterned image may be a material (e.g., ink, fountain solution, toner, surfactants, particulates), electromagnetic property (e.g., positive charge, negative charge) or state (e.g., solid, fluid) that may be affected by heating, as well understood to a skilled artisan. Operation of the method proceeds to Step S220, where during the moving, a controller selectively switches the heating elements to a heating on state to heat the regions including the patterned image or areas of the surface where the patterned image will be rendered. The heating elements may be selectively switched via active matrix addressing. Operation may cease at Step S220, or may continue by repeating back to Step S210, for continued movement and patterned heating of the surface adjacent the array of switching heating elements.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 12, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Those skilled in the art will appreciate that other embodiments of the disclosed subject matter may be practiced with many types of image forming elements common to offset inking system in many different configurations. For example, although digital lithographic systems and methods are shown in the discussed embodiments, the examples may apply to analog image forming systems and methods, including analog offset inking systems and methods. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A heat image forming device for selectively heating an adjacent surface, comprising an array of switching heating elements, with each heating element being a field effect transistor, the transistors each having a semiconductor layer, a gate electrode, a source electrode, a drain electrode and a dielectric layer deposited as thin-films onto a substrate, the gate electrode separated from the drain electrode and source electrode by the dielectric layer, the semiconductor layer having a current channel defined by a spatial gap between the source electrode and gate electrode, and an overlapping distance of the drain and source electrodes in the semiconductor layer;

a plurality of conductive lines including gate address lines, current supply data lines, and current return lines, with each one of the gate electrodes electronically coupled to one of the gate lines, each one of the source electrodes electronically coupled to one of the data lines, and each one of the drain electrodes electronically coupled to one of the current return lines, each heating element having a current supplied via a connecting current supply data line in the current channel that is controlled by a voltage applied to the gate electrode via a connecting gate address line;

wherein the current channel is closer to the surface being heated than the current return lines.

2. The device of claim 1, wherein the current channel is closer to the surface than the conductive lines.

3. The device of claim 1, wherein the current return lines are offset from the gate electrode by a second dielectric layer and opposite the drain electrode.

4. The device of claim 3, wherein the current return lines form a current return mesh layer offset from the gate electrode by the second dielectric layer and opposite the source and drain electrodes, with different ones of the current return lines running parallel to both the gate address lines and the current supply lines.

5. The device of claim 1, wherein the field effect transistor has a bottom gate configuration having, in order of deposition, the gate electrode, the dielectric layer, both the source electrode and the drain electrode, and the semiconductor layer.

6. The device of claim 5, wherein one of the current return lines is deposited before the gate electrode and is in conductive contact with the drain electrode deposited above the one of the current return lines.

7. The device of claim 1, wherein the field effect transistor has a top gate configuration having, in order of deposition, the semiconductor layer, both the source electrode and the drain electrode, the dielectric layer, the gate electrode and one of the current return lines.

8. The device of claim 7, wherein the semiconductor layer is deposited over a release layer over a carrier, released from the carrier after the field effect transistor fabrication, and then inverted onto a support layer to place the current channel adjacent the surface being heated.

9. The device of claim 1, further comprising a passivation layer over the semiconductor layer and adjacent the surface being heated to protect the current channel.

10. The device of claim 9, further comprising a surface layer over the passivation layer, the surface layer having a material configured for contact with the surface being heated.

11. The device of claim 10, wherein the surface layer material is thermally conductive.

12. The device of claim 1, wherein the semiconductor layer includes one of an oxide semiconductor, an organic semiconductor, a polysilicon, an amorphous silicon, and carbon nanotubes.

13. The device of claim 1, further comprising gate line drivers coupled to the gate address lines and data line drivers coupled to the current supply data lines on both ends thereof.

14. The device of claim 1, further comprising gate line drivers coupled to the gate address lines and data line drivers coupled to the current supply data lines, wherein there is a voltage drop along the current supply data lines so that field effect transistors distal from the data line drivers have a greater voltage drop than heating elements proximal to the data line drivers, and the current channels of the field effect transistors distal from the data line drivers have a width-to-length ratio different than the field effect transistors proximal to the data line drivers.

15. A method of selectively heating an adjacent surface with the heat image forming device of claim 1, wherein the adjacent surface includes a plurality of regions, with some of the regions including a patterned image on the surface or areas of the surface where the patterned image will be rendered, the method comprising:

a) moving the patterned image of the adjacent surface and the array of switching heating elements relative to each other, b) during the moving, selectively switching the heating elements proximal to the patterned image to a first state based on the patterned image, and c) heating only the regions including the patterned image or areas of the surface where the patterned image will be rendered.

16. The method of claim 15, further comprising selectively switching the heating elements via active matrix addressing.

17. A system for selectively heating an adjacent surface with the heat image forming device of claim 1, wherein the adjacent surface includes a plurality of regions, with some of the regions including a patterned image, the system comprising:

a processor and a memory, the memory storing instructions to cause the processor to perform:

a) moving the patterned image of the adjacent surface and the array of switching heating elements relative to each other, b) during the moving, selectively switching the heating elements proximal to the patterned image to a first state based on the patterned image, and c) heating only the regions including the patterned image or areas of the surface where the patterned image will be rendered.

18. The system of claim 17, further comprising gate line drivers coupled to the gate address lines and data line drivers coupled to the current supply data lines, wherein there is a voltage drop along the current supply data lines so that heating elements distal from the data line drivers have a greater voltage drop than heating elements proximal to the data line drivers, and the memory storing further instructions to cause the processor to control the data line drivers to increase an applied voltage to heating elements at locations distal from the data line drivers.

19. A heat image forming system for selectively heating an adjacent surface, comprising an array of switching heating elements, with each heating element having a semiconductor layer, a gate electrode, a source electrode, a drain electrode and a dielectric layer between the gate electrode and both the source and drain electrodes, the semiconductor layer having a current channel;

a plurality of conductive lines including gate address lines, current supply data lines, and current return lines, with each one of the gate electrodes electronically coupled to one of the gate lines, each one of the source electrodes electronically coupled to one of the data lines, and each one of the drain electrodes electronically coupled to one of the current return lines, each heating element having a current supplied via a connecting current supply data line in the current channel that is controlled by a voltage applied to the gate electrode via a connecting gate address line;

wherein the current return lines are offset from the gate electrode by a second dielectric layer and opposite the drain electrode, and the current channel is closer to the surface being heated than the current return lines.

20. The system of claim 19, wherein the current return lines form a current return mesh layer offset from the gate electrode by the second dielectric layer and opposite the source and drain electrodes.

* * * * *